United States Patent [19]

Vann

[11] 4,151,880

[45] May 1, 1979

[54] VENT ASSEMBLY

[75] Inventor: Roy R. Vann, Houston, Tex.

[73] Assignee: Peabody Vann, Houston, Tex.

[21] Appl. No.: 843,151

[22] Filed: Oct. 17, 1977

[51] Int. Cl.[2] ..... E21B 43/12

[52] U.S. Cl. ..... 166/314; 137/630.14; 166/332; 251/319

[58] Field of Search ..... 166/314, 332, 324; 251/210, 319; 137/629, 630.14, 630.15

[56] References Cited

U.S. PATENT DOCUMENTS

| | | | |
|---|---|---|---|
| 3,051,243 | 8/1962 | Grimmer et al. | 166/332 |
| 3,071,193 | 1/1963 | Raulins | 166/332 |
| 3,151,681 | 10/1964 | Cochran | 166/332 |

*Primary Examiner*—James A. Leppink

[57] ABSTRACT

A vent assembly for use in a tubing string located downhole in a borehole. The vent assembly is moved to the open position by a fishing tool attached to a slick line and run downhole through the tubing string into engagement therewith. The vent assembly includes an elongated, annular piston which slidably and sealingly engages the inside peripheral wall of a housing. The housing has radial ports which are covered by spaced seals located on the annular piston. One of the seals is larger in diameter than the other, thereby presenting different surface areas to the bottomhole fluids of the borehole within which the assembly is located. A sliding valve element underlies the annular piston and covers a relatively small bleed port so that when the valve element is moved by the wireline actuated tool to uncover the bleed port, the pressure differential across the housing is equalized. The sliding valve element is engaged by the wireline fishing tool and moved uphole to uncover the bleed port and thereafter moved further uphole to open the vent port.

12 Claims, 7 Drawing Figures

VENT ASSEMBLY

BACKGROUND OF THE INVENTION

It is often necessary to run a tubing string down into a wellbore which has a bottomhole pressure of several thousand pounds. Sometimes the tubing string includes a packer which packs off the lower borehole annulus from the upper annulus as seen for example in my previously issued U.S. Pats. No. 3,812,911; 3,871,448; 3,912,013; 3,931,855; 3,990,507; and 4,009,757.

Mechanically actuated vent assemblies are often difficult to manipulate for the reason that the bottomhole pressure causes the pressure differential across the tubing string to often amount to several thousand psi, and therefore, an enormous amount of pressure is exerted through the vent ports and against the sliding element associated with the vent assembly. The difficulty often reaches a magnitude which appears insurmountable and the technicians sometimes find themselves resorting to the use of a knocker, or jar, and other impact type tools in order to force the sliding sleeve to move into the open position.

In deep wells having an extremely large bottomhole pressure, the rapid opening of the sliding sleeve causes a sudden and tremendous inrush of fluids to occur. The fluids enter the vent assembly and flow up the tubing string with sufficient violence to simulate a wild well, and it is very distressing to attempt to bring such a well under control, especially when some sort of trouble is precipitated by the energy dissipated by the sudden onrush of the extremely high pressure well fluids.

It is costly to remove all of the tubing string and attendant equipment from a deep well as is necessary when the vent assembly refuses to be actuated to the open position. It is furthermore costly to be forced to shut-in a well as a result of the sudden onrush of fluids precipitating damage to the tool string or wellhead. Accordingly, it is desirable to be able to run an improved vent assembly downhole into a high pressure borehole and to subsequently actuate the vent assembly in such a manner to slowly equalize the pressure before opening the well to flow. Such a desirable expedient would eliminate the potentiality of the above damage and thereby avoid the necessity of removing the entire tool string from the borehole; and furthermore, would avoid the destructive onrush of high pressure fluids through the various piping and valves associated with the completion of the borehole. A vent assembly having the above desirable attributes is the subject of the present invention.

SUMMARY OF THE INVENTION

A vent assembly for use in a tubing string located downhole in a borehole which comprises a housing having an axial flow passageway formed therethrough through which fluids can flow to and from the bottom of the borehole. A lateral flow passageway is formed by a radially disposed vent port so that fluid can occur directly from the casing annulus into the axial passageway when the vent assembly is in the open configuration. A second, relatively small, bleed passageway is also formed laterally through the housing so that a smaller flow stream can occur from the casing annulus into the axial flow passageway when the bleed passageway is open.

An annular piston is reciprocatingly received within the housing and is positioned to cover the vent port so that fluid flow therethrough is precluded. The annular piston can be reciprocatingly moved into the opened position to uncover the vent port and thereby allow fluid flow to occur directly from the annulus, through the vent port, and into the axial flow passageway.

The bleed passageway is covered by an annular valve member which can be slidably moved respective to the housing and annular piston. This action uncovers the bleed passageway, thereby enabling a small flow to occur from the casing annulus, through the bleed passageway, and into the axial flow passageway. The small flow equalizes the pressure differential across the vent assembly over an extended time interval.

The valve element is arranged to be engaged by a wireline fishing tool so that it can be manipulated from the surface and moved into the open position. The annular piston and valve element are arranged respective to one another to cause the valve element to move into abutting engagement with the annular piston, whereupon the pressure across the vent assembly is equalized, and thereafter the valve element is further moved to force the annular piston to slide in an uphole direction so that the vent port is open to flow.

Stop means and latch means are provided so that the annular piston and valve element can be positively moved from the closed into the latched open position.

The annular piston includes spaced apart relatively large and small diameter portions, respectively, which are received within a relatively large and small diameter portion of the housing, respectively, with a seal means being placed about the relatively large and small diameter portions, and with the vent port being located between the seal means so that pressure is effected upon the two different diameter portions. Hence, the differential in area causes the piston to be biased into the closed position. Consequently, a significant bottomhole pressure differential across the tool biases the annular piston into the closed position with several hundred pounds force, thereby precluding inadvertent opening thereof until the pressure has been equalized by first opening the valve element and allowing the pressure to equalize across the bleed passageway.

Accordingly, a primary object of the present invention is the provision of a downhole vent assembly which is opened to flow in a two-step operation wherein the pressure must first be equalized before any appreciable flow into the tubing can occur.

Another object of the invention is the provision of a vent assembly having vent ports therein covered by a member which is biased to the closed position by the bottomhole pressure.

A further object of this invention is to disclose and provide a wireline actuated vent assembly which is opened in a two-stage operation wherein the first stage entails slowly equalizing the pressure across the vent assembly and thereafter moving the vent ports to the opened position.

A still further object of this invention is to provide a method of communicating the interior of a tubing string with a casing annulus wherein the hydrostatic head is greater in the annulus respective to the interior of the tubing by using the downhole pressure to bias the vent ports to the closed position until the pressure differential across the tool has been slowly equalized and thereafter the vent ports moved to the opened position.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
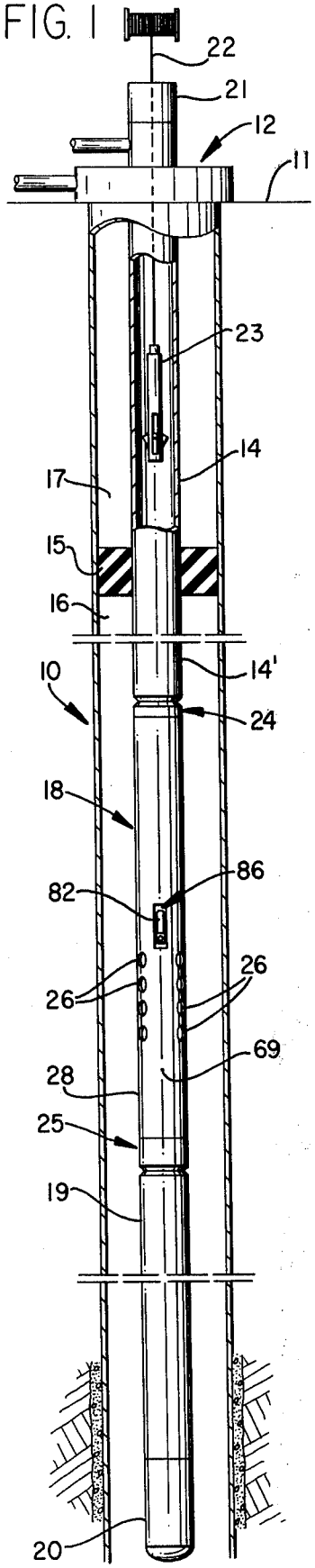
FIG. 1 is a part schematical, part diagrammatical representation of a vent assembly made in accordance with the present invention and located downhole in a borehole.
Figure 2:
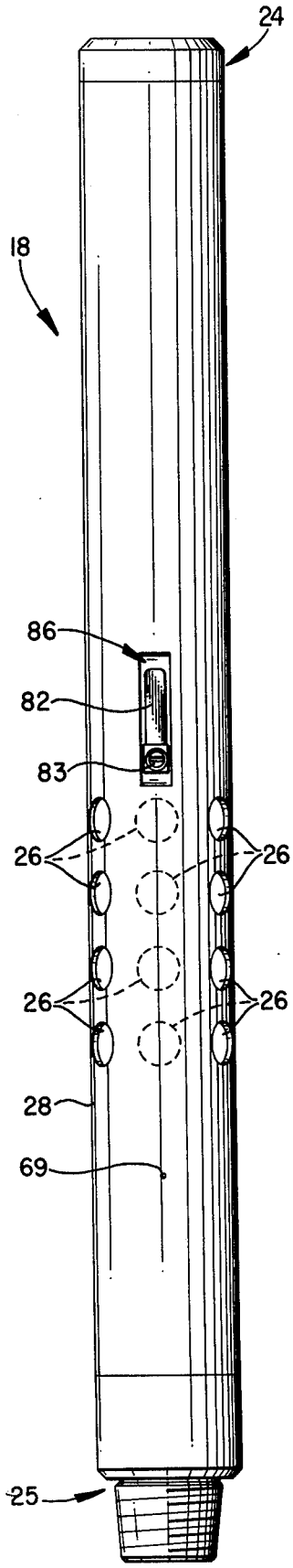
FIG. 2 is an enlarged, elevational view of the vent assembly disclosed in FIG. 1.
Figure 5:
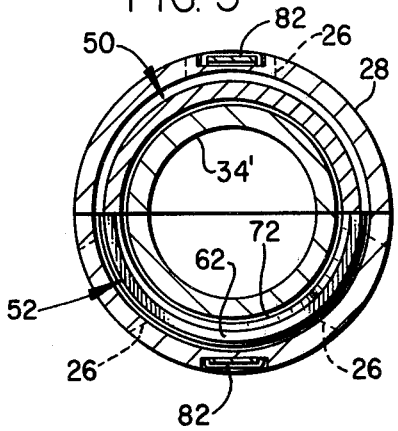
Figure 6:
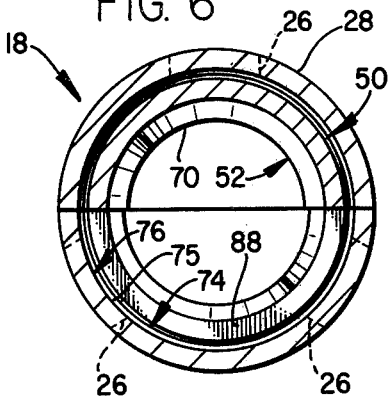
Figure 7:
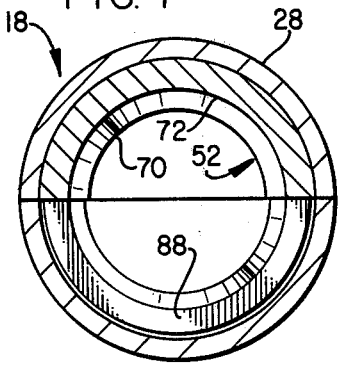

In FIG. 1, a cased borehole 10 extends below the surface 11 of the ground and terminates in a wellhead 12. A tubing string 14 is concentrically arranged respective to the casing and extends downhole several thousand feet through the illustrated, hydrocarbon producing formation. A packer 15 separates a lower casing annulus 16 from an upper casing annulus 17.

A vent assembly 18, made in accordance with the present invention, is series connected into the tubing string so that any desired tool string 19 or downhole tool 20 can be connected thereto.

A lubricator 21 of the usual design is affixed to the upper terminal end of the tubing. A wireline 22, sometimes called a slick line, is used to run a tool 23, such as an Otis shifting tool, downhole into the borehole for a purpose which will become more evident as the present disclosure is more fully digested.

The vent assembly of the present invention is more specifically illustrated in FIGS. 2–7, and is provided with the usual upper box end in the form of a sub 24, and a pin end in the form of a lower sub 25. A plurality of vent ports 26 are formed within the housing of the vent assembly so that when the vent ports are opened, flow can occur from the hydrocarbon producing formation, through the vent ports, into the tubing string, and uphole to the surface of the ground.

Figures 3, 4:
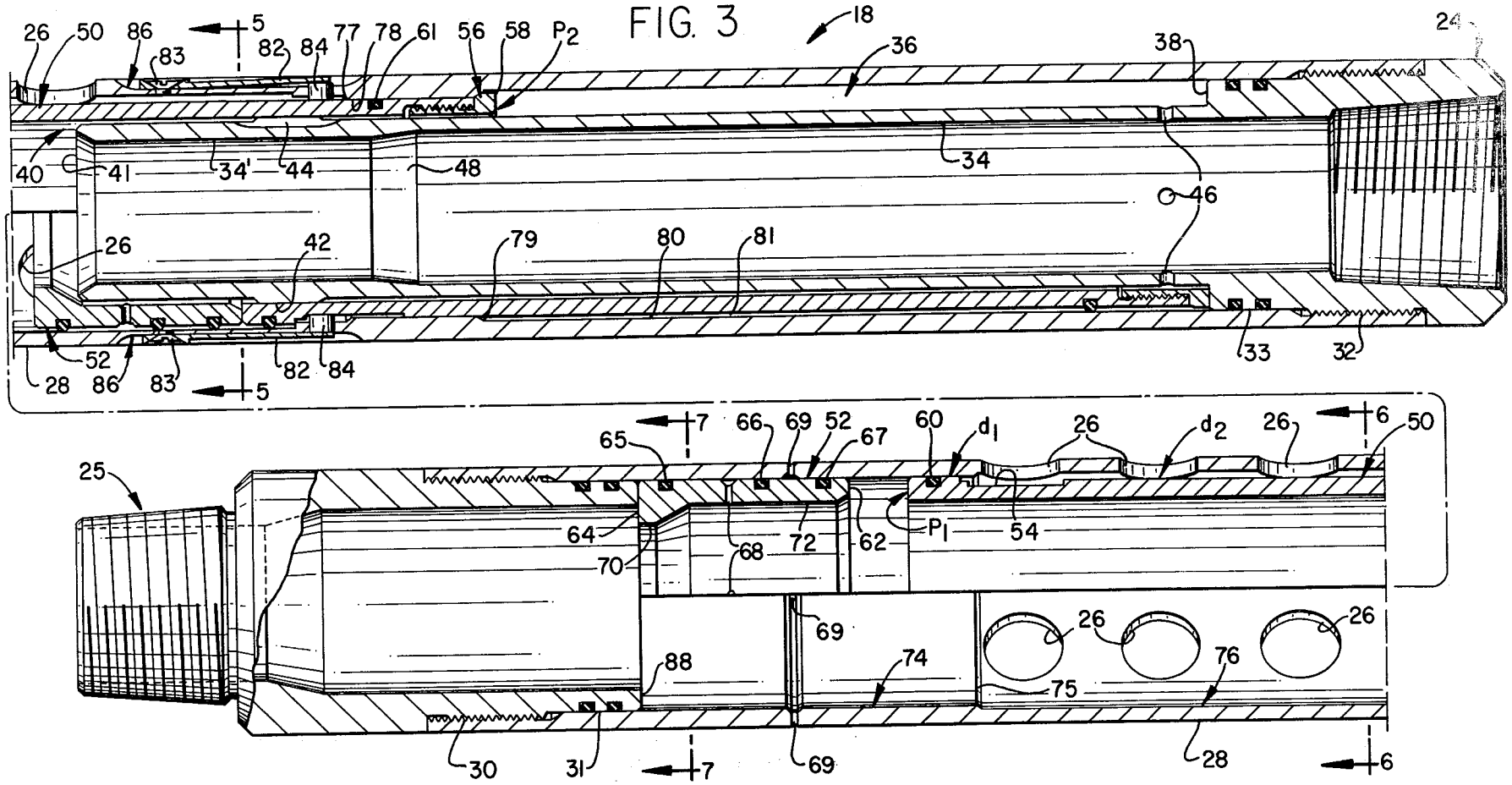
FIG. 3 is an enlarged, longitudinal, cross-sectional view of the vent assembly disclosed in FIG. 2, with the upper half of the drawing disclosing the vent assembly in the closed configuration, while the lower half of the drawing discloses the vent assembly in the fully opened configuration.
FIG. 4 is an enlarged, broken view of part of the apparatus disclosed in FIGS. 2 and 3; and, FIGS. 5, 6, and 7, respectively, are cross-sectional views taken along lines 5—5, 6—6, 7—7, respectively, of FIG. 3.

FIG. 3 more specifically illustrates the details of the vent assembly. The vent assembly includes a main housing 28 which threadedly engages the lower sub by means of the threaded connection at 30. O-ring seals located at 31 assure a fluid-type connection. The upper end of the housing threadedly engages the upper sub by means of the threaded surface 32, and additionally includes O-rings at 33 to assure a seal between the casing annulus and the interior of the tubing.

A reduced diameter inner sleeve 34 is an integral portion of the upper sub and forms a working annulus 36 between the housing and the fixed sleeve. The working annulus opens into the interior of the housing at the location indicated by the arrow at numeral 40. The free terminal end 41 of the fixed sleeve terminates a specific relative distance from the upper sub, as will be appreciated later on in this disclosure.

A marginal medial length of the exterior of the fixed sleeve is enlarged in diameter and presents a boss at 42. The outer surface of the boss is interrupted by three longitudinally arranged slots 44 radially spaced apart 120°. Radially spaced-apart ports 46 communicate the interior of the fixed sleeve with the working annulus 36. The marginal free end of the interior of the fixed sleeve is reduced in diameter by the conical, inwardly sloped portion 48.

An annular piston in the form of the illustrated, longitudinally traveling sleeve 50 reciprocates within the working annulus and is spaced from a valve element in the form of a short traveling sleeve 52 which can follow the long traveling sleeve a portion of the distance into the working annulus, as indicated by the lower half of the drawings. The long traveling sleeve will hereinafter be referred to as an "annular piston", while the short traveling sleeve will hereinafter be referred to as a "valve element".

The annular piston has a reduced diameter, circumferentially extending groove 54 formed near the lower end thereof, a large diameter boss D1, a small diameter body portion D2, with the groove 54 being located between D1 and D2. A ring 56 is threadedly affixed to the upper marginal end of the annular piston and provides an enlargement or circumferentially extending boss 58. O-ring 60 is placed within the relatively large diameter D1 part of the annular piston, while O-ring 61 is placed in the relatively small diameter D2 part of the piston, thereby providing a slidable piston assembly having an area represented by D1 minus D2 exposed to the bottomhole pressure which tends to drive the piston in a downhole direction. The enlarged end P1 of the piston is opposed to an upper end P2 of the piston.

The upper end 62 of the valve element terminates in a circumferentially extending shoulder which can be moved into abutment with shoulder P1 of the annular piston. The opposed end 64 of the valve element terminates in a relatively larger shoulder so that a suitable fishing tool can be run downhole on the end of a slick line and into engagement therewith. Circumferentially extending seal means 65, 66, and 67 sealingly engage the interface formed between the interior of the housing and the exterior of the valve element. A plurality of radially spaced apart drilled holes 68 extend laterally through the valve element and are located between seals 65 and 66. A plurality of radially spaced drilled passageways 69 are formed laterally through the wall of the housing, with the interior of the ports being joined by the illustrated, circumferentially extending groove. The groove and ports are located between seals 66 and 67. The shoulder 64 inwardly extends and terminates to form the small diameter 70, which is sufficiently large to admit various tool strings down through the tubing string, through the vent assembly, and to any apparatus 20 which may be located below the lower string 19.

The lateral flow passageways 68 and 69 form bleed ports when brought into alignment with one another. The bleed ports are aligned in indexed relation when shoulder 62 is moved uphole into abutting engagement with shoulder P1 of the annular piston. The bleed ports 68 and 69 need not be brought into registry with one another because the annular grooves therebetween permit flow to occur when brought into alignment with one another.

The housing includes a small i.d. 74 which enlarges at 75 into a larger i.d. 76, and thereafter again reduces at 77 into a small i.d. 78, and again enlarges at 79 into a larger i.d. 80.

Shoulder 79 forms a stop against which the enlarged head 58 is received, thereby determining the lowermost position of the annular piston. Annulus 81 is formed between the annular piston and the upper marginal, inside peripheral wall surface of the housing.

Leaf spring 82 is secured by means of screw 83 to the housing. Pin 84 is affixed to the free end of the leaf spring and is thereby biased towards the axial passageway of the tool. The leaf spring is received within the illustrated recess 86, where it is protected from damage.

Shoulder 88 of the lower sub forms a stop against which shoulder 64 of the valve element is abuttingly received when the tool is in the "running-in" configuration. At this time, lateral bleed port 68 and 69 are misaligned with respect to one another, thereby maintaining the interior of the vent assembly in the dry, low pressure, isolated condition.

Large diameter D1 of the annular piston is slightly larger than the diameter of the piston at seal 61. For example, where the upper sub calls for 2⅜ inch BUE 8 round thread for accommodating a 2⅜ inch API size external upset tubing, it is preferable to make D1 about 2.94 inches in diameter, while D2 is made 2.81 inches in diameter, thereby providing a total of about ¾ square inch difference in area. This 0.75 square inch differential effects about 3500 pounds closing force assuming that a 5,000 psi bottomhole pressure differential is found downhole in the wellbore. Accordingly, it is quite apparent that the annular piston cannot be inadvertently moved with a slick line until this pressure differential has been eliminated, whereupon only gravity is left for biasing the annular piston in a downward direction.

The purpose of the fixed sleeve is to provide the before mentioned working annulus which protects an annular piston and valve element from being inadvertently moved in a downward direction during subsequent workover operations. For this reason, the lower end 41 of the fixed sleeve is brought into close proximity to the lower end 70 of the valve element, with the enlarged diameter 72 being received about the lower marginal end of the fixed sleeve. Hence, any toolstring which may subsequently be lowered through the valve assembly will be isolated from contact with either the annular piston or the valve element.

In operation any number of known fishing tools, such as a modified Otis shifting tool, is run down through the tubing string, through the fixed sleeve, down through the traveling piston, and into engagement with shoulder 64 of the valve element, whereupon the slick line is tightened and a constant pressure of 100 or 200 pounds is held on the slick line to make certain that the valve element has shifted uphole, with shoulder 62 thereof being brought into abutting engagement with shoulder P1 of the piston. This action communicates the bleed ports or lateral passageways 68 and 69 with one another, thereby enabling flow to occur from the casing annulus into the tubing string.

During this time, the valve (not shown) on the wellhead is closed and the slick line is under considerable tension. The annular piston cannot be moved because it is being held closed by the pressure differential thereacross. However, as the pressure differential approaches zero, as evidence by increased pressure measured at 12, the tension in the slick line will move the valve element further uphole, causing the annular piston to move therewith and into the retracted or opened configuration as seen illustrated in the lower half of FIG. 3. As the annular piston is retracted, the pin 84 of the latch assembly is received within groove 54, thereby locking the annular piston into the retracted configuration, with the main vent ports being open so that flow can occur from the casing annulus into the vent assembly and up the tubing string to the surface of the earth. Accordingly, the fishing tool and slick lines are now removed from the tubing string, the valve at the wellhead opened, and the well placed on production with there being no danger of shocking the well with any sudden surge of flow.

I CLAIM:

1. A slick line actuated vent assembly comprising a main outer housing, means forming a sub at either end of said main housing for connecting said housing into a tubing string, at least one vent port formed laterally through a sidewall of said housing through which fluid can flow; a first traveling element for controlling flow through said vent port, a second traveling element for equalizing the pressure across said housing;

said first and second elements being received within said housing, said second traveling element being located downhole of said first traveling element and movable in an uphole direction into abutting engagement with said first traveling element, a relatively small bleed port formed through said housing for equalizing pressure thereacross when flow occurs therethrough;

means by which said second traveling element is positioned to be moved from a lower to an upper location; seal means for preventing flow through said bleed port when said second traveling element is in the lower location, and when moved uphole to enable flow to occur through said bleed port; pressure responsive means biasing said first traveling element towards a closed position when a pressure differential is effected across said main outer housing;

so that said second element can be engaged by a wireline tool and moved uphole into abutting engagement with said first element to open said small bleed port and equalize the pressure across the tool and thereby remove the biasing force from said first traveling element, whereupon said first element can then be moved uphole by further movement of said second element, thereby opening said vent port.

2. The vent assembly of claim 1 wherein said first and second traveling elements are annular in construction to provide a longitudinal axial passageway;

said first traveling element having a large outside diameter marginal length spaced from a small outside diameter marginal length, said housing having spaced large and small inside diameter marginal lengths for receiving the corresponding spaced large and small outside diameter marginal lengths of said first traveling element;

said large outside diameter marginal length of said first traveling element being located downhole of said vent port so that the downhole pressure exerted at said vent port biases the first traveling element towards a closed position.

3. The vent assembly of claim 1 wherein said first traveling element is in the form of an annular piston, an upper stop means located within said housing against which said piston is abuttingly received when moved into the open position;

said second traveling element is in the form of an annular valve element, a lower stop means against which said annular valve element is abuttingly received;

said annular valve element abuttingly engages said annular piston when said annular valve element is moved uphole;

so that said annular valve element is moved into engagement with said piston to equalize the pressure across the housing, and said annular valve element thereafter moves said piston uphole to uncover the vent port.

4. The vent assembly of claim 1, and further including a latch means by which the first traveling element is latched into the open position when moved uphole by the second element.

5. The vent assembly of claim 1 wherein said first traveling element is in the form of an annular piston, an upper stop means located within said housing against which said piston is abuttingly received when moved into the open position;

said second traveling element is in the form of an annular valve element, a lower stop means against which said valve element is abuttingly received;

said annular valve element abuttingly engages said annular piston when said valve element is moved uphole;

so that said valve element is moved into engagement with said piston to equalize the pressure across the housing, and said valve element thereafter moves said piston uphole to uncover the vent port;

and further including a latch means by which the first traveling element is latched into the open position when moved uphole by the second element;

and an inner sleeve member which surrounds the first and second elements when the first and second elements are moved uphole.

6. The vent assembly of claim 1 wherein said first traveling element can be moved from a lower position to an upper position;

means for preventing flow through said vent port when said first traveling element is in the lower position, and for enabling flow through said vent port when said first traveling element is in the upper position.

7. A vent assembly for use in a tubing string located downhole in a borehole comprising a housing having an axial passageway through which fluid can flow, a sub formed at each extremity of said housing for connecting the vent assembly into a tubing string; a vent port formed through said housing and into communication with the axial passageway;

an elongated annular piston concentrically positioned within said housing, seal means at each extremity of said piston which sealingly engages the inner surface of said housing and the outer surface of said piston, stop means for limiting the downward travel of said piston relative to said housing, said vent port being located intermediate said seal means when said piston abuttingly engages said stop means;

an annular sliding element concentrically arranged respective to said housing and slidably respective to said annular piston, a lateral bleed passageway formed through said housing which communicates with said axial passageway, spaced seal means on the exterior of said sliding element for sealing the outer surface of the sliding element and the inner surface of said housing, a lower stop means against which said sliding element is abuttingly received when the element is moved into a lowermost position, said lateral bleed passageway being positioned between said seals of said sliding element when the sliding element is in the lowermost position, thereby precluding flow therethrough;

a shoulder formed on said sliding element which can be engaged by a wireline tool thereby enabling said element to be forced uphole whereupon said lateral bleed passageway is uncovered and fluid flows through said housing and into said axial passageway;

said lower stop means includes means on said sliding element for engaging and moving said annular piston in an uphole direction so that an upward force can be applied to the piston for moving the piston uphole to thereby uncover said vent port and enable flow to occur between said axial passageway and said vent port.

8. The vent assembly of claim 7 wherein said annular piston is provided with spaced large and small diameter marginal portions, respectively, and said housing is provided with spaced large and small diameter marginal inside wall surfaces, respectively, which sealingly receive said large and small diameter marginal portions of said piston; said seals being located on said large and small diameter marginal portions of said piston so that a downhole pressure in excess of the internal tubing pressure exerts a downward closing force on said piston;

whereby the piston is biased closed by the downhole pressure differential effected across the tool.

9. The vent assembly of claim 7 and further including a latch means by which said annular piston is latched into the opened position when moved uphole by the sliding element.

10. The vent assembly of claim 7 and further including a fixed inner sleeve concentrically arranged respective to said annular piston, sliding element, and housing, for guidably receiving said annular piston and slidable element therewithin when the tool is moved into the opened position.

11. The vent assembly of claim 7 wherein said sliding element is an annular cylinder which can be moved into abutting engagement with said annular piston, thereby moving said piston uphole, and having a radial bleed port which is placed in communication with said lateral flow passageway when moved uphole into abutment respective to said piston, and after the pressure across the tool has equalized, the sliding element can be moved further uphole to thereby move the piston therewith and thereby open the vent port.

12. Method of communicating the interior of a tubing string with a borehole annulus wherein the hydrostatic head is greater in the borehole annulus respective to the interior of the tubing, comprising the steps of:

forming a relatively large vent port and a relatively small bleed port from the annulus into the tubing string;

covering the vent port with a slidable annular piston, forming spaced large and small outside diameter marginal lengths on the piston and sealingly receiving the large and small outside diameter marginal lengths of the piston within complementary large and small inside diameter portions of the tubing so that the piston is forced in a downhole direction;

covering the bleed port with a sliding element to preclude flow therethrough;

moving the sliding element uphole by running a wireline downhole and engaging the sliding element therewith, whereupon the bleed port is uncovered and the pressure differential across the tubing is equalized; and, thereafter moving the piston uphole to uncover the vent port by engaging the piston with the sliding element and moving both the sliding element and piston uphole by further movement of the wireline.

* * * * *